United States Patent [19]

Schmid

[11] 4,033,404

[45] * July 5, 1977

[54] OSCILLATORY MOLD EQUIPPED WITH A HOLLOW MOLD CAVITY WHICH IS CURVED IN THE DIRECTION OF TRAVEL OF THE STRAND

[75] Inventor: Markus Schmid, Zurich, Switzerland

[73] Assignee: Concast AG, Zurich, Switzerland

[ * ] Notice: The portion of the term of this patent subsequent to Jan. 13, 1993, has been disclaimed.

[22] Filed: Apr. 28, 1975

[21] Appl. No.: 571,937

[30] Foreign Application Priority Data

May 15, 1974 Switzerland ..... 6694/74

[52] U.S. Cl. ..... 164/260; 164/282; 164/283 S

[51] Int. Cl.[2] ..... B22D 11/12

[58] Field of Search ..... 164/89, 283 R, 283 S, 164/283 M, 260, 282

[56] References Cited

UNITED STATES PATENTS

| | | | |
|---|---|---|---|
| 3,129,474 | 4/1964 | Olsson | 164/83 |
| 3,358,744 | 12/1967 | Rossi | 164/283 S X |
| 3,623,536 | 11/1971 | Moritz | 164/89 |
| 3,931,848 | 1/1976 | Schmid | 164/89 X |

FOREIGN PATENTS OR APPLICATIONS

| | | | |
|---|---|---|---|
| 814,435 | 6/1959 | United Kingdom | 164/283 M |

*Primary Examiner*—Robert D. Baldwin
*Attorney, Agent, or Firm*—Werner W. Kleeman

[57] ABSTRACT

An oscillatory or reciprocating continuous casting mold having a hollow mold cavity which is curved or arc-shaped in the direction of travel of the strand for cooling an essentially rectangular steel strand which is forming, the mold comprising a first cooling device for the indirect cooling of the strand and a second cooling device equipped with strip-shaped support surfaces and intermediately located cooling water channels, these cooling water channels being provided with water infeed means. Between the first cooling device and the second cooling device there is arranged an intermediate space which is open at all sides. In the second cooling device the course of the cooling water channels in both of the mold walls associated with the straight or planar sides of the strand in the direction of travel of the strand follows the arc of the hollow mold cavity.

7 Claims, 2 Drawing Figures

OSCILLATORY MOLD EQUIPPED WITH A HOLLOW MOLD CAVITY WHICH IS CURVED IN THE DIRECTION OF TRAVEL OF THE STRAND

BACKGROUND OF THE INVENTION

The present invention relates to a new and improved construction of oscillatory or reciprocating mold of the type having a hollow mold cavity or compartment which is curved or arc-shaped in the direction of travel of the strand for cooling an essentially rectangular steel strand which is forming, the aforesaid continuous casting mold comprising a first cooling device for indirect cooling of the strand and a second cooling device equipped with strip-shaped support surfaces and between such support surfaces intermediately disposed cooling water channels, there cooling water channels being equipped with water infeed means.

During the continuous casting of steel, especially at high casting speeds, it is extremely important that there be produced as uniform and as thick as possible strand shell or skin upon departure of the case strand or casting out of the mold.

Due to the contraction of the strand shell within the mold such lifts off of the mold walls and, depending upon the crosssection of the strand and the taper of the hollow mold cavity or compartment, produces an irregular contact of the strand with the walls of the mold viewed over the periphery of the strand. Due to this irregular contact of the strand with the mold walls there is formed, especially at the lower portion of the mold, a strand shell which is of varying thickness at the outlet end of the mold and possesses the well known drawbacks, such as for instance, diamond profile, fissures, metal breakouts and so forth.

Hence, for the purpose of producing strands having a uniform thickness of the shell over the periphery of the strand at the outlet end of the mold it therefore was beneficial to use short molds equipped with a subsequently arranged spray cooling device. However, the thickness of the strand shell at such mold is thin at the time that the strand departs from the mold and thus severely prone to the metal breakout phenomena, so that even the slightest defects at the strand shell can precipitate metal breakout. Thus, from the standpoint of counteracting metal breakout long molds are preferred. But such long molds possess at the lower region thereof an extremely small cooling efficiency or capacity, and considered with regard to the periphery of the mold, an irregular cooling capacity. Thus, such molds are not suitable for high-speed casting operations where there should prevail safeguards against metal breakout, especially when casting billet- and bloom-cross-sections.

There is known to the art an oscillating or reciprocating mold having an arc-shaped or curved mold cavity which, viewed in the direction of travel of the strand, possesses two different successively arranged cooling devices. The first cooling device consists of cooled walls which indirectly cool the strand shell or skin forming therein. Directly following such first cooling device is the second cooling device which is equipped with support surfaces and intermediately located strip-shaped cooling water channels. These cooling water channels which are open at the strand infeed side are provided with water infeed means for the direct cooling of the strand. However, this mold construction is associated with the drawback that the vapor forming in the cooling water channels can ascend in the shrinkage gap between the mold walls and the strand in the indirectly cooled mold portion up to the level of the molten metal bath and thus can cause explosions. Apart from this drawback such mold construction, however, possesses a still further shortcoming. With incipient metal breakouts, which again close due to solidification in the cooling water channels, there are formed with respect to the strand surface protruding whisker- of teardrop-like irregularities. In the case of a larger incipient metal breakout such a resulting repaired location, even along a shorter path, can completely fill the entire hollow space of the cooling water channel. Due to the relative movement between the oscillating mold and the moving strand there are effective at such repaired locations shearing moments due to the straight lateral boundary surfaces of such channels, which can again tear open such locations. Consequently, on the one hand there is considerably reduced the metal breakout-preventing effect of such cooling device and, on the other hand, there is considerably increased the danger of explosions which arise due to penetration of water into the torn or broken open strand shell.

SUMMARY OF THE INVENTION

Hence, it is a primary object of the present invention to provide an improved construction of oscillating mold having an arc-shaped mold cavity or compartment, and which mold structure is not associated with the aforementioned drawbacks and shortcomings of the prior art proposals.

Another and more specific object of the present invention aims at the provision of an improved mold construction which no longer possesses the aforementioned drawbacks.

Yet a further object of the invention aims at the provision of a new and improved construction of mold wherein such mold at its lower region possesses an increased and adjustable cooling efficiency or capacity, in order to be able to produce continuously cast steel strands at high casting speeds with reduced danger of metal breakout and good geometry of the cast strand.

Another significant object of the invention is the provision of a novel mold of the aforementioned type which safeguards against tearing open of metal breakouts which have been repaired within the cooling device and thus overcoming the associated danger of explosion due to penetration of water or vapor into the strand.

Now in order to implement these and still further objects of the invention, which will become more readily apparent as the description proceeds, the mold construction of this development is manifested by the features that between the first cooling device and the second cooling device there is provided an intermediate space which is open at all sides, and that in the second cooling device the course of the cooling water channels in both of the mold walls associated with the straight sides of the strand in the direction of travel of the strand follow the arcshape of the hollow mold cavity.

With the inventive mold of this development it is possible to intensively cool the strand at the lower mold region and to accommodate the cooling action to the required conditions, without there occurring any danger of explosions due to the rising of vapors through the gap between the mold and the strand and penetrating into the region of the level of the molten metal bath in the mold. In contrast to the cooling water channels which, according to the prevailing state-of-the-art, extend linearly or at an inclination to the curved longitudinal axes of the strand, the metal breakouts which have been repaired in the cooling water channels constructed according to the invention can be withdrawn without being loaded by a shearing component acting at the strand shell or skin. As a result, the metal breakout rate at high casting speeds is considerably reduced and there is eliminated the danger of explosions due to penetration of water into damaged portions of the strand shell or skin. The direct cooling in the last or terminal cooling device, also at high casting speeds, produces a sufficiently thick and uniform shell, so that there can be particularly fabricated billet- and bloom shapes possessing good geometry of the strand.

In order to improve the cooling effect of both of the mold walls associated with the curved sides of the strand, but also for increasing the uniformity of the direct cooling within the mold between the mold walls associated with the curved and the straight sides of the strand, it is advantageous according to a further facet of the invention if the depth of the cooling water channels is constant in both of the mold walls associated with the curved sides of the strand.

The metal breakout which has been repaired in a cooling water channel forms in relation to the strand surface a protruding whisker-like irregularity which, upon contraction of the strand shell can bind with a surface limiting the width of the cooling water channel and can exert a shearing moment. In order to eliminate this drawback it is advantageous if the width of the cooling water channels increases in the direction of travel of the strand. Additional advantages with respect to detachment of such irregularities from the mold wall can be realized if the depth of the cooling water channels in the mold walls increases in the direction of travel of the strand.

In order to permit large tolerances for the fabrication and adjustment of such mold walls provided with cooling water channels, it is possible according to a further aspect of the invention to define the boundary line of the cross-section of the cooling water channels by an intermediate convex curve and two lateral concave curves.

In order to prevent that scale and/or flux powder slag will clog the hollow mold space which is open at all sides, it is advantageous if the intermediate space or compartment which is open at all sides is bounded at the side nearer the mold outlet by surfaces which are slopingly downwardly inclined away from the strand. The common edges which are formed by such inclined surfaces and the sides confronting the strand can be constructed as scraping or stripping edges. Moreover, it is possible to maintain the inclined or sloped surfaces clean by the application of water, compressed air or otherwise.

An effective and uniform cooling action with a low water pressure can be realized according to a further advantageous construction of the invention if the water infeed means or water infeed lines are arranged at the end face of the cooling water channels at the infeed side of the strand.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE INVENTION

Figure 1:
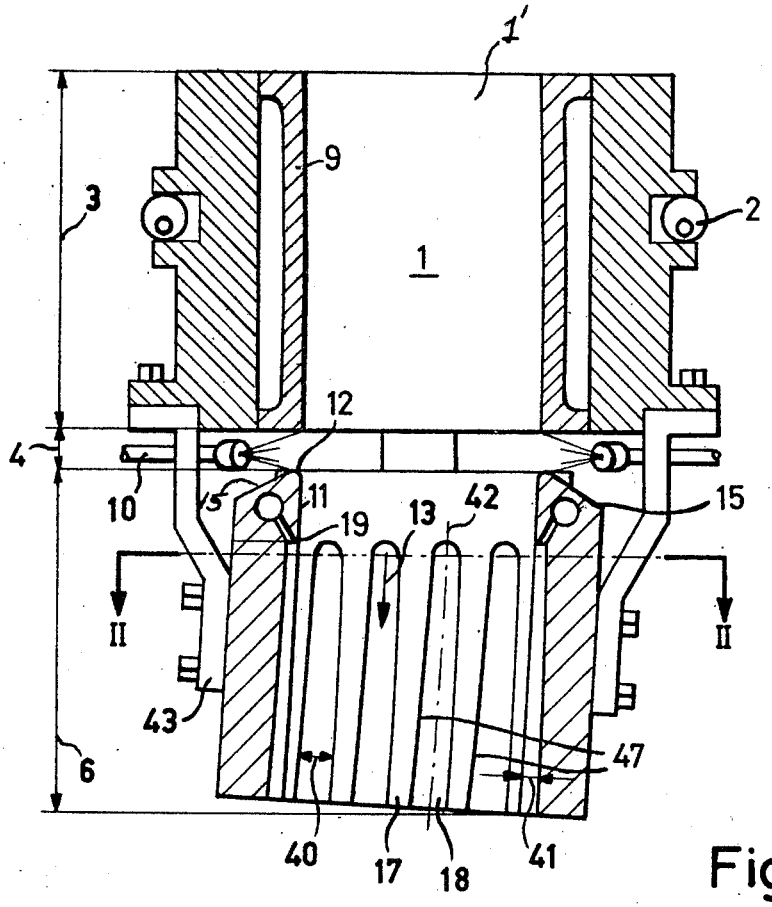
FIG. 1 is a vertical sectional view through a mold constructed according to the teachings of the present invention.

Describing now the drawing, it is to be understood that only enough of the continuous casting installation has been depicted therein in order to simplify the illustration while still showing sufficient structure to enable those versed in the art to fully understand and appreciate the underlying concepts of the invention. Hence, in FIG. 1 reference character 1 designates a continuous casting mold having an arc-shaped or curved mold cavity or compartment 1' in the direction of travel of the strand which has not been particularly shown in the drawing, and which hollow mold cavity serves, for instance, for the casting of square or quadratic billets or blooms. By means of any suitable and therefore schematically illustrated oscillating or reciprocating drive 2 the continuous casting mold 1 is oscillated in conventional manner. This mold 1 is a multiple-part mold and essentially consists of the successively arranged cooling devices 3 and 6. The cooling device 3, viewed in the direction of strand travel, defines a first cooling device for the indirect cooling of the strand and consists of the water cooled copper walls 9 limiting the hollow mold cavity or compartment 1'. These walls are advantageously conical i.e. tapered for example, so that the hollow mold compartment 1' narrows or tapers in accordance with the contraction or shrinkage of the cast strand. Reference character 4 designates an intermediate space which is open at all sides. Spray nozzle 10 can cool the strand in this open hollow space of the continuous casting mold. Consequently, the strand prior to entry into the cooling drive 6 can be appropriately intensively cooled in accordance with the prevailing requirements.

The second cooling device 6 in the exemplary embodiment under discussion is additionally provided at the inlet side with a support element 11 which supports the strand and indirectly cools such strand. This support element 11 which extends transversely with respect to the strand direction of travel 13 about the hollow mold cavity is provided with stripping or scraping edges 12. The intermediate space 4 which is open at all sides is bounded at the outlet or discharge side for the strand by the surfaces 15 which are slopingly inclined downwardly away from the strand.

This intermediate space 4 which is open at all sides and follows the first cooling device 3, is preferably 3 to 20 mm long in the direction of travel 13 of the strand. This length is chosen as a general rule such that the time required for passage of the strand through this open hollow mold cavity amounts to less than 1 second. In the case of billet shapes, such as for instance possessing the dimensions of 120×120 mm and with a casting speed of 4 m/min the throughpassage time amounts to 0.18 seconds with a height of 12 mm of the intermediate zone or space 4. In such short time-intervals any possibly starting metal breakouts have much too little time to develop into a non-repariable breakout.

The second cooling device 6 essentially consists of strip-shaped arranged support surfaces 17 and intermediately situated cooling water channels 18 possessing a semi-circular cross-sectional configuration. These cooling water channels 18 are provided with water infeed means or conduits 19. The boundary of the width 40 of the cooling water channels 18 in both of the mold walls 45 associated with the straight sides of the strand are curved in the strand direction of travel 13 in accordance with the arc of the hollow mold cavity. The depth 41 of the cooling water channels 18 in both of the mold walls 44 associated with the curved sides of the strand are appropriately accommodated to the arc of the hollow mold cavity. In addition to the arc-shaped accommodation of the width boundary and the depth boundary of the cooling water channels 18 the width 40 of the cooling water channels 18 can increase in the direction of travel 13 of the strand. In the embodiment under discussion the boundary of the depth 41 of the cooling water channels 18 however also diverges in the direction of travel 13 of the strand. The taper formed by such divergence amounts to approximately 1%.

The width 40 of such cooling water channels 18 and the width of the support surfaces 17 can be selected to be between 5 to 50 mm, depending upon the strand format or shape. In the case of a billet shape with the dimensions 100 × 100 mm cooling water channels 18 of 10 mm width and support surfaces 17 of 10 mm width have been found to be particularly useful.

Figure 2:
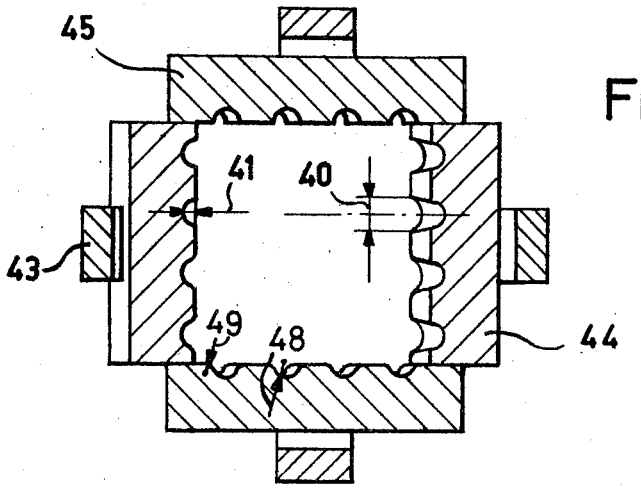
FIG. 2 is a cross-sectional view of the mold shown in FIG. 1, taken substantially along the line II—II thereof.

As a variant of the semi-circular shaped boundary lines of the cross-section of the cooling water channels in the upper half of the showing of FIG. 2, there are shown in the lower half of such Figure cooling water channels having a central or intermediate convex curve and two lateral concave curves, that is to say, the boundary line of the cross-section consists of a radius 48 and two rounded portions 49.

The cooling capacity or efficiency of the cooling device 6 is determinable, on the one hand, by the adjustable quantity of water serving as the coolant and, on the other hand, by the depth 41 of the cooling water channels 18, wherein with decreasing depth 41 and with the same amount of water the cooling capacity becomes greater. As a general rule these channels are fabricated so as to have a depth amounting up to approximately 4 mm. The infeed conduits 19 for the cooling water in such channels are advantageously arranged at the end face in such a manner that the cooling water flows along the strand in its direction of travel 13. However, it is also possible to introduce the water transversely with respect to the direction of travel 13 of the strand into the channels. The channels 18 can however also extend continuously over the entire length of the cooling device 6. In this way the water, in the event of a metal breakout within the cooling device 6 and with a clogging of such channels, can escape upwardly.

The cooling device 6 is connected via a support frame 43 or equivalent structure with cooling device 3. By means of a not particularly illustrated adjustment mechanism, for instance screws, it is possible to adjust the casting taper of the cooling device 6 independently of that of the cooling device 3. In order to be able to improve the guiding of the strand in the cooling device 6 and to reduce the wear of the cooling device 6 by the action of the strand, it is advantageous to mount at the outer side thereof a not particularly illustrated roller crown or rim.

In the cooling device 6, the length of which can amount to 30% to 60% of the first cooling device 3, there is supported approximately 50% to 70% of the surface of the still thin strand shell. The strand surface is intensively cooled by the water which flows therepast. Due to the high flow velocity of the cooling water in the cooling channels which are open at one side there is practically completely prevented a pressure increase within the channels and in the event of a possibly damaged strand shell or skin there is thus rendered impossible any penetration of vapor and water into the strand.

The total length of the described multiple-part mold amounts to 950 mm in the case of, for instance, a billet crosssection of 120 × 120 mm and with a casting speed of 4 m/min.

The described mold structure can also be usefully employed when casting slab shapes or formats.

While there are shown and described present preferred embodiments of the invention, it is to be distinctly understood that the invention is not limited thereto, but may be otherwise variously embodied and practiced within the scope of the following claims.

ACCORDINGLY,

I claim:

1. An oscillating continuous casting mold having a hollow mold cavity bounded by four mold walls and which hollow mold cavity is arc-shaped in the direction of travel of the strand for cooling a strand which is forming, two of said mold walls being operably associated with straight sides of the strand and the other two mold walls being operably associated with the curved sides of the strand, said oscillating continuous casting mold comprising a first cooling device for the indirect cooling of the strand and a second cooling device having substantially strip-shaped support surfaces and intermediately disposed cooling water channels, the width of said cooling water channels increasing in the direction of travel of the strand, coolant water infeed means provided for said cooling water channels, an intermediate space which is open at all sides disposed between the first cooling device and the second cooling device, the course of the cooling water channels in the second cooling device at both mold walls which are associated with the straight sides of the strand substantially following the arc of the hollow mold cavity in the direction of travel of the strand.

2. The mold as defined in claim 1, wherein the depth of the cooling water channels in both mold walls associated with the curved sides of the strand is substantially constant.

3. The mold as defined in claim 1, wherein the depth of the cooling water channels in the mold walls increases in the direction of travel of the strand.

4. The mold as defined in claim 1, wherein the boundary line of the cross-section of each of the cooling water channels is defined by an intermediate convex curve and two lateral concave curves.

5. The mold as defined in claim 1, wherein the mold has an outlet for the strand, the intermediate space which is open at all sides is bounded at the side thereof closer to said outlet of the mold by surfaces which are downwardly inclined in a direction away from the strand.

6. The mold as defined in claim 1, wherein each of the cooling water channels have an end surface located at an infeed side for the strand, the coolant water infeed means being arranged at the region of said end surfaces of the cooling water channels located at said infeed side of the strand.

7. The mold as defined in claim 1, wherein the length of the intermediate space which is open at all sides, viewed in the direction of travel of the strand, is in the order of between about 3 to 20 mm.

* * * * *